US005832985A

United States Patent [19]

Pleschiutschnigg et al.

[11] Patent Number: 5,832,985

[45] Date of Patent: Nov. 10, 1998

[54] PROCESS AND DEVICE FOR PRODUCING A STEEL STRIP WITH THE PROPERTIES OF A COLD-ROLLED PRODUCT

[75] Inventors: Fritz-Peter Pleschiutschnigg, Duisburg; Ingo von Hagen, Krefeld; Wolfgang Bleck; Paul Splinter, both of Aachen, all of Germany

[73] Assignee: Mannesmann Aktiengesellschaft, Düsseldorf, Germany

[21] Appl. No.: 817,784

[22] PCT Filed: Sep. 21, 1995

[86] PCT No.: PCT/DE95/01347

§ 371 Date: Apr. 21, 1997

§ 102(e) Date: Apr. 21, 1997

[87] PCT Pub. No.: WO96/12573

PCT Pub. Date: May 2, 1996

[30] Foreign Application Priority Data

Oct. 20, 1994 [DE] Germany ..... 44 38 783.0
May 31, 1995 [DE] Germany ..... 195 20 832.3

[51] Int. Cl.[6] ..... B22D 11/12; B21B 1/04

[52] U.S. Cl. ..... 164/4.76; 164/477; 164/417; 29/527.7

[58] Field of Search ..... 164/476, 477, 164/417; 29/527.7, 33 R

[56] References Cited

U.S. PATENT DOCUMENTS 5,329,688 7/1994 Arvedi et al. ..... 29/527.7

FOREIGN PATENT DOCUMENTS

WO 92/22389 12/1992 WIPO ..... 29/527.7

*Primary Examiner*—Kuang Y. Lin

*Attorney, Agent, or Firm*—Cohen, Pontani, Lieberman & Pavane

[57] ABSTRACT

A process for producing a steel strip with properties of a cold-rolled product. The process including comprising the sequential steps of: a) producing a thin slab 30 to 100 mm thick from a steel melt by continuous casting in a continuous casting machine, and, after a cast strip emerges from a mold of the continuous casting machine, cast rolling the cast strip with a liquid core to reduce thickness of the cast strip by at least 10%; b) descaling the thin slab produced according to step a); c) hot rolling the descaled thin slab at temperatures in a range of 1150° to 900° C. for reducing thickness by at least 50% to produce an intermediate strip with a maximum thickness of 20 mm; d) after hot rolling, accelerated cooling of the intermediate strip to a temperature in a range of 850° to 600° C.; e) rolling down the cooled intermediate strip by isothermic rolling at 850° to 600° C. on a finishing train with at least three stands into strips with a maximum thickness of 2 mm, whereby the strip thickness is reduced by at least 25% per roll pass; and f) subsequently cooling the isothermic rolled steel strip in accelerated fashion to a temperature no greater than 100° C.

30 Claims, 1 Drawing Sheet

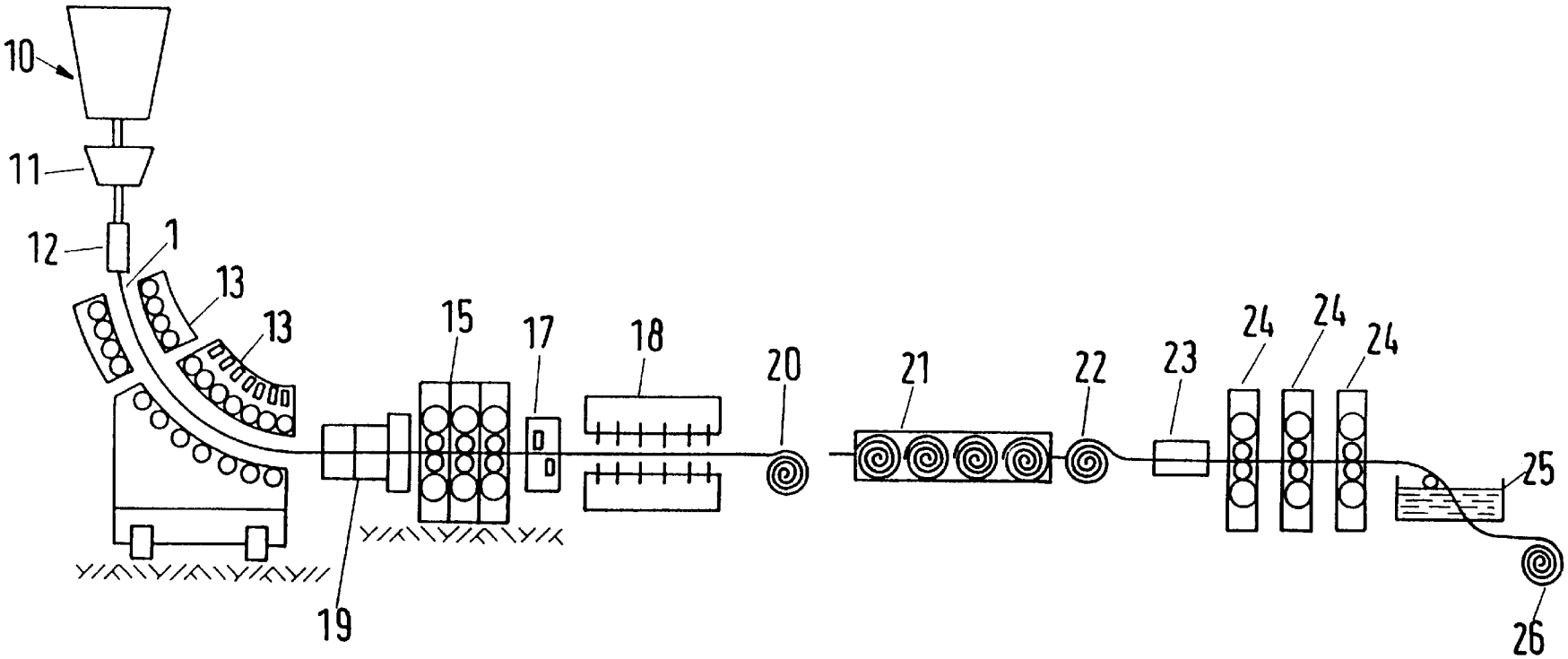
10
11
12
1
13
13
15
17
18
19
20
21
22
23
24
24
24
25
26

PROCESS AND DEVICE FOR PRODUCING A STEEL STRIP WITH THE PROPERTIES OF A COLD-ROLLED PRODUCT

BACKGROUND OF THE INVENTION

Field of the Invention

The invention relates to a process for producing a steel strip with the properties of a cold-rolled product, as well as to a machine for implementing this process.

From EP 0 541 574 B1 a generic process is known in which finished strip with the properties of a cold-rolled product is produced in a hot-rolling train directly from feedstock that was cast close to final size. In this process, a thin continuous slab with a maximum thickness of 100 mm is produced in a continuous casting machine. The cast strip, which has a liquid core, is then rolled to solidification thickness (cast rolling) on a rolling device located directly behind the continuous casting mold. After this, the thin slab is descaled and hot-rolled at temperatures above 1100° C. to a thickness of 10–30 mm on a rolling device with, for example, three stands. The intermediate strip hot-rolled in this manner is divided into partial lengths by means of strip shears. Preferably, these partial lengths are wound into coils and later unwound for further hot rolling and, as needed, further descaling. Prior to being hot rolled again, and preferably before being wound into coils, the strip-type material is reheated inductively to a hot-rolling temperature above 1100° C. The second hot-rolling process is carried out at a temperature above $Ar_3$. Immediately after this, the strip is cooled to a temperature below $Ar_3$, preferably a temperature in the range of 600° to 250° C. The strip produced in this manner is subsequently finish-rolled by being cold rolled on one or more sequential stands and then wound into coils.

The known process is intended to produce cold-rolled strip while expending as little energy as possible. For this purpose, the methods of casting close to final size (thin slab production) and cast-rolling are used, i.e., thickness reduction is carried out while the hot cast strip still has a partly liquid core. Furthermore, hot rolling is carried out, in part, using the heat left over from the continuous casting process. It is disadvantageous that, despite the utilization of heat from the continuous casting, the strip-type intermediate product must be heated inductively for the second portion of hot rolling.

SUMMARY OF THE INVENTION

The object of the present invention is to provide a process, as well as a machine for its implementation, which avoids separate reheating of the strip-type intermediate product and the energy and equipment expense associated therewith. In addition, the properties of the produced material are to be improved to the greatest extent possible in the direction of cold-rolled properties.

Pursuant to this object, and others which will become apparent hereafter, one aspect of the present invention resides in a process for producing a steel strip with the properties of a cold-rolled product, by carrying out the following sequential steps: a) producing a thin slab 30 to 100 mm thick from a steel melt by continuous casting in a continuous casting machine, and after a cast strip emerges from a mold of the continuous casting machine, cast rolling the a cast strip with a liquid core to reduce the thickness of the cast strip by at least 10%; b) descaling the thin slab produced according to step a); c) hot rolling the descaled thin slab at temperatures in a range of 1,150° to 900° C. for reducing thickness by at least 50% to produce an intermediate strip with a maximum thickness of 20 mm; d) after hot rolling, accelerated cooling of the intermediate strip to a temperature in a range of 850° to 600° C.; e) rolling down the cooled intermediate strip by isothermic rolling at 850° to 600° C. on a finishing train with at least three stands into strips with a maximum thickness of 2 mm, whereby the strip thickness is reduced by at least 25% per roll pass; and f) subsequently cooling the isothermic rolled steel strip in accelerated fashion to a temperature no greater than 100° C.

In another embodiment of the inventive process the thin slab is reduced during cast rolling by at least 20%, and in particular 30%.

Still another embodiment the inventive process includes hot rolling the intermediate strip to a thickness of 10–20 mm.

In yet another embodiment of the inventive process the isothermic rolling is carried out in four or five passes.

In another embodiment the intermediate strip is isothermically rolled to a thickness of 0.5 to 1.5 mm.

In still yet a further embodiment of the invention the thin slab is produced from a melt of steel of deep drawing quality.

In contrast to the process known from EP 0 541 574 B1, the present invention calls for only a single continuous hot-rolling process. Thus, it dispenses with a second hot-rolling step and with the intermediate inductive heating necessary for such a step. Instead, according to the invention, hot rolling is carried out in a single pass, at the end of which rapid cooling to a temperature in the range of 850° to 600° C. takes place. When this temperature is reached, the finished steel strip is produced by isothermic rolling in at least three roll passes, in each of which a thickness reduction of at least 35% is achieved. After this finish rolling, the strip is rapidly cooled to a temperature no greater than 100° C. In contrast, in the known process, finish rolling is carried out at a considerably lower temperature (approximately 250° to 600° C.). During isothermic rolling according to the present invention, the temperature of the steel strip does not remain constant in the strict sense; however, temperature changes remain within a relatively narrow tolerance band (e.g., $\Delta T=0°$ to 20° C.). In isothermic rolling, the temperature must never fall below a critical value; furthermore, the unavoidable heat loss due to radiation must be at least compensated for by the deformation work performed on the steel strip. Advantageously, the process is conducted in such a manner that the heat contribution from special deformation work ("speed up") always remains greater than the expected heat loss from radiation, while temperatures are controlled by targeted cooling between roll passes. If the actual temperature of the steel strip falls below a critical value, even once, during the rolling process, it is almost impossible to raise the temperature again to the in desired value by changing the rolling parameters.

BRIEF DESCRIPTION OF THE DRAWING

The invention is explained in greater detail below in reference to the schematic diagram shown in the single drawing.

DETAILED DESCRIPTION OF THE PREFERRED EMBODIMENTS

From a ladle 10, a melt of steel, preferably deep drawing steel, is poured into a tundish 11. The tundish 11 allows the steel melt to flow in a continuous stream into a continuous casting mold 12 located below it, which has a liquid cooling device (not shown) and serves to create a cast strip, consisting of the strip shell and a liquid core. In this state, the hot cast strip enters a cast-rolling device 13 located below the continuous casting mold 12. The cast-rolling device further reduces the thickness of the cast strip with the partially liquid core. As a result, a thin continuous slab 1 with a thickness of 30 to 100 mm, preferably 40 to 70 mm, emerges from the cast-rolling device 13. The thickness reduction during cast rolling amounts to at least 10%, preferably at least 30%. After this, the strip enters a descaling device 19, which is preferably embodied as a hydromechanical descaler. After descaling, the thin slab 1 has a temperature in the range of 1150° C. to 900° C. In this state, the thin slab 1 is supplied to a hot-rolling device 15 arranged directly behind the descaling device 19. In the hot-rolling device 15, the thickness of the thin slab 1 is reduced by at least 50% to form an intermediate strip with a maximum thickness of 20 mm, preferably 10 to 20 mm. In some cases, it may also be advantageous to provide an equalizing furnace (not shown) directly in front of the hot-rolling device 15 to keep the thin slab, which is advantageously divided into partial lengths, at the desired hot-rolling temperature. Behind the hot rolling device 15, which advantageously has two or three stands or a reverse rolling mill, it is normally advisable to connect a separation aggregate, e.g., in the form of strip shears 17, for the purpose of dividing the produced intermediate strip into the aforementioned partial lengths. According to the invention, the hot-rolled intermediate strip is rapidly cooled to a temperature in the range of 850° to 600° C. The particular cooling temperature to be advantageously selected is based, in each case, on the chemical composition of the steel as well as on the desired microstructure and mechanical-technical properties to be attained in the finished strip. Cooling is carried out in a first cooling device 18, which is attached directly to the strip shears 17 in the drawing. In many cases, it is advisable for reasons of space to coil the partial lengths of intermediate strip (which are at the temperature desired for the subsequent finish-rolling) into coils in a coiling device 20 and to keep these intermediate strip coils at the desired temperature in an equalizing furnace 21. On an uncoiling device 22 connected directly behind the equalizing furnace 21, the intermediate strip is unwound again for subsequent finish rolling. Prior to finish rolling, it is advantageous to again carry out descaling in a descaling device 23, for example, to avoid quality impairments due to newly formed scale. Finish rolling is carried out as isothermic rolling in the temperature range of 600° to 850° C. on a rolling device 24, which has at least three stands. In many cases, a rolling device with four or, at a maximum, five stands is advisable. A larger number of finish rolling stands is generally not advantageous. The rolling stands are operated in such a way that the strip thickness is reduced by at least 25% per roll pass. Upon leaving the rolling device 24 the finished strip has a maximum thickness of 2 mm, preferably 0.5 to 1.5 mm. To ensure the (approximately) isothermic rolling conditions, it is advisable for cooling devices (not shown) that extract the excess heat in a controlled fashion, e.g., spray cooling devices, to be provided between the individual roll stands of the rolling device 24. The actual temperature of the steel strip in the rolling device 24 is monitored by conventional temperature sensors (not shown). The steel strip emerging from the rolling device 24 is immediately rapid-cooled to a temperature no greater than 100° C. in a second cooling device 25. This rapid cooling is advantageously carried out at a cooling rate in the range of 10° to 25° C./s. For this purpose, the finished strip can be fed through a liquid cooling bath, for example. However, it is also possible, in the known manner, to use spray cooling devices over the course of the roller table at the smallest possible roll distances of less than 250 mm. Advantageously, the finished strip produced in this way should be coiled up for transport in the form of coils. The schematic diagram shows an appropriate coiling device 26 for this purpose.

The planned creation of intermediate strip coils between the hot rolling device 15 and the rolling device 24 has the advantage of forming a material buffer, which makes the rolling device less prone to malfunction during operation. Furthermore, the equalizing furnace 21 needed to maintain the temperature of the buffer material requires relatively little space.

Process Example

A melt of a deep drawing steel with 0.04% C
0.02% Si
0.21% Mn
0.018% P
0.006% S
0.035% Al
0.05% Cu
0.05% Cr
0.04% Ni
0.0038% N
Residual iron and standard impurities ($T_{liq}$≅1520° C.)

was cast in a continuous casting machine for thin slabs at a temperature of approximately 1540° C. Upon leaving the continuous casting mold, the cast strip 80 mm thick and 1300 mm wide still had a liquid core. At the mold exit, the mean temperature of the cast strip was approximately 1310° C. In this state, the thin slab strip was fed into a cast-rolling device and reduced in thickness by 25%, resulting in a solidification thickness of 60 mm. After descaling with the help of a pressurized water jet, the thin slab strip was reduced in thickness by approximately 66% on a three-stand hot-rolling train, creating an intermediate strip with a thickness of 20 mm. The temperature was 1130° C. upon entrance into the hot rolling train and 938° C. upon emergence. Immediately after this, the intermediate strip was divided into partial pieces and rapidly cooled to a temperature of approximately 700° C. After passage through an equalizing furnace operated at 700° C. and after descaling, intermediate strip coils produced from the partial lengths were supplied to the finish-rolling train. The finish-rolling train had a total of five stands operating at a total thickness reduction of 95%. The intermediate strip fed to the first roll stand at 650° C. had, upon exiting this stand, a somewhat higher temperature of 658° C., which was then reduced again to approximately 650° C. by a spray cooling device arranged in front of the second roll stand. Similarly, the exit temperature after the second roll stand of 664° C. was reduced by a further spray cooling device in front of the third roll stand to an entry temperature for the third roll stand of 650° C. The same applies to the fourth and fifth stands. Immediately after this, the finish strip produced in this manner with a thickness of 1.00 mm was cooled in a water cooling bath at a cooling rate of 21° C./s to approximately 90° C. and then wound into finished coils. The finished strip manufactured in this manner had outstanding mechanical-technical properties comparable to those of cold strip.

The finishing method according to the invention results in the formation of an especially fine-grained microstructure, which is clearly more advantageous than the results obtained according to the process known from EP 0 541 574 B1. In the known process, the reheating to 1100° C. that is carried out before the second hot-rolling step leads to marked grain coarsening. This cannot happen in the process according to the invention, because of the selected temperature range of 850° to 600° C. A further difference in respect to grain size results from the different manner of finish rolling. In the process according to the invention, additional dynamic grain refinement takes place, as do increases in strength and toughness, during isothermic rolling, which is carried out at temperatures ont the recrystallization threshold and with at the prescribed total deformation degree of distinctly over 90%. Due to the clearly smaller deformations in the individual roll passes, this does not occur in the known process with any such distinctness. The high strength values that can be achieved by means of cold-hardening in the known process can also be established according to the process according to the invention by means of a suitably adjusted roll cycle. In addition, these improved values will be accompanied by clearly improved toughness properties. In summary, it can be said that steel strip produced by the process according to the invention is distinguished by its combination of very high strength values with extraordinarily good deformation and toughness properties.

We claim:

1. A process for producing a steel strip with properties of a cold-rolled product, comprising the sequential steps of:

a) producing a thin slab 30 to 100 mm thick from a steel melt by continuous casting in a continuous casting machine, and, after a cast strip emerges from a mold of the continuous casting machine, cast rolling the cast strip with a liquid core to reduce thickness of the cast strip by at least 10%;

b) descaling the thin slab produced according to step a);

c) hot rolling the descaled thin slab at temperatures in a range of 1150° to 900° C. for reducing thickness by at least 50% to produce an intermediate strip with a maximum thickness of 20 mm;

d) after hot rolling, accelerated cooling of the intermediate strip to a temperature in a range of 850° to 600° C.;

e) rolling down the cooled intermediate strip by isothermic rolling at 850° to 600° C. on a finishing train with at least three stands into strips with a maximum thickness of 2 mm, whereby the strip thickness is reduced by at least 25% per roll pass; and f) subsequently cooling the isothermic rolled steel strip in accelerated fashion to a temperature no greater than 100° C.

2. A process as defined in claim 1, and further comprising the step of coiling the strip cooled in step f) as finished strip.

3. A process as defined in claim 1, wherein the thin slab producing step includes producing the thin slab with a solidification thickness of 40–70 mm.

4. A process as defined in claim 1, wherein the thin slab producing step includes cast rolling the thin slab to reduce the thickness by at least 20%.

5. A process as defined in claim 4, wherein the thin slab producing step includes cast rolling the thin slab to reduce the thickness by 30%.

6. A process as defined in claim 1, and further comprising the step of holding the thin slab at temperature in an equalizing furnace prior to hot rolling.

7. A process as defined in claim 1, wherein the hot rolling step includes producing the intermediate strip with a thickness of 10–20 mm.

8. A process as defined in claim 1, and further comprising the step of dividing the intermediate strip into partial lengths and coiling up the partial lengths into coils after step d).

9. A process as defined in claim 1, and further comprising the step of keeping the intermediate strip cooled in step d) at its cooling temperature in an equalizing furnace prior to isothermic rolling.

10. A process as defined in claim 1, wherein the isothermic rolling is carried out in one of four passes and five passes.

11. A process as defined in claim 1, wherein step e) includes isothermically rolling the strip to a thickness of 0.5 to 1.5 mm.

12. A process as defined in claim 1, wherein the step of subsequently cooling the steel strip includes cooling at a cooling rate in a range of 10° to 25° C./s.

13. A process as defined in claim 1, and further comprising the step of descaling the intermediate strip immediately prior to isothermic rolling in step e).

14. A process as defined in claim 1, wherein the descaling step includes hydromechanically descaling the thin slab.

15. A process as defined in claim 1, wherein the step of rolling down the cooled intermediate strip includes controlling temperature of the intermediate strip between individual roll passes during isothermic rolling.

16. A process as defined in claim 15, wherein the controlling temperature of the intermediate strip during isothermic rolling includes spray cooling.

17. A process as defined in claim 1, wherein step a) includes producing the thin slab from a melt of a steel of deep drawing quality.

18. A machine for producing a steel strip with cold-rolled properties, comprising:

a continuous casting device to produce thin slabs, the continuous casting device having a mold;

a cast rolling device located immediately behind, in a strip production direction, the mold of the continuous casting device;

a first descaling device located behind the cast-rolling device;

a hot rolling device, which comprises one of at least two stands and one reversing stand, connected to the descaling device, for producing intermediate strip;

first cooling means arranged behind the hot rolling device for accelerated cooling of the intermediate strip produced in the hot rolling device;

rolling means arranged behind the first cooling means, the rolling means including at least three roll stands for isothermic rolling of the cooled intermediate strip; and second cooling means immediately behind the rolling means for accelerated cooling of a steel strip produced by the rolling means.

19. A machine as defined in claim 18, wherein the descaling device is a hydromechanical descaling device.

20. A machine as defined in claim 18, and further comprising an equalizing furnace located between the cast rolling device and the hot rolling device.

21. A machine as defined in claim 18, and further comprising separation means arranged behind the hot rolling device for dividing the hot rolled intermediate strip into partial lengths.

22. A machine as defined in claim 21, and further comprising a coiling device and an uncoiling device for the intermediate strip partial lengths, behind the first cooling means.

23. A machine as defined in claim 21, and further comprising heating means between the first cooling means and the isothermic rolling means for maintaining the temperature of the partial lengths of the intermediate strip.

24. A machine as defined in claim 22, and further comprising heating means between the coiling device and the uncoiling device for maintaining the temperature of the partial lengths of the intermediate strip.

25. A machine as defined in claim 18, and further comprising a second descaling device directly in front of the isothermic rolling means.

26. A machine as defined in claim 18, wherein the hot rolling device includes three stands.

27. A machine as defined in claim 18, wherein the isothermic rolling means includes one of four stands and five stands.

28. A machine as defined in claim 18, and further comprising coiling means arranged behind the second cooling means, for coiling up the strip.

29. A machine as defined in claim 18, and further comprising cooling devices arranged between the roll stands of the rolling means for isothermic rolling temperature control of the strip.

30. A machine as defined in claim 29, wherein the cooling devices are spray cooling devices.

* * * * *